United States Patent [19]

Spindeler

[11] Patent Number: 4,666,559

[45] Date of Patent: May 19, 1987

[54] CLOSURE FOR A GAS OFFTAKE PIPE

[75] Inventor: Heinz Spindeler, Bochum, Fed. Rep. of Germany

[73] Assignee: Dr. C. Otto & Comp. GmbH, Bochum, Fed. Rep. of Germany

[21] Appl. No.: 762,269

[22] Filed: Aug. 5, 1985

[30] Foreign Application Priority Data

Aug. 25, 1984 [DE] Fed. Rep. of Germany ..... 3431298

[51] Int. Cl.[4] ..... C10B 27/00

[52] U.S. Cl. ..... 202/254; 202/269

[58] Field of Search ..... 202/242–244, 202/246, 247, 254–256, 258–260, 268, 269; 266/159; 196/136; 138/89; 48/87

[56] References Cited

U.S. PATENT DOCUMENTS 4,168,208 9/1979 Althoff et al. ..... 202/254
4,197,164 4/1980 Pries ..... 202/256
4,239,602 12/1980 La Bate ..... 202/242
4,296,938 10/1981 Offermann et al. ..... 202/242
4,379,023 4/1983 Stratmann et al. ..... 202/247

*Primary Examiner*—Barry S. Richman
*Assistant Examiner*—Joye L. Woodard
*Attorney, Agent, or Firm*—Thomas H. Murray; Clifford A. Poff

[57] ABSTRACT

A closure is provided for the top opening of a circular or oval cross section gas offtake pipe provided on the roof for a coke oven chamber to conduct gasses from the chamber to a gas main. The closure includes a domed top cover and an inner cover. The peripheral edge of the top cover dips into a water seal provided on the top edge of the gas offtake pipe when the cover is in a closed position. The edge of the inner cover engages a peripheral top sealing edge of an annular wall which is disposed at a distance from the water seal inwardly thereof. The top seal edge of the annular wall is disposed above a base of the water seal.

7 Claims, 3 Drawing Figures

CLOSURE FOR A GAS OFFTAKE PIPE

BACKGROUND OF THE INVENTION

This invention relates to a closure for closing the top opening of a gas offtake pipe having a circular or oval cross-sectional configuration and disposed on the roof of a coke oven to conduct raw gas evolving in an oven chamber during the coking of coal to a main. More particularly, the closure of the present invention includes a domed top cover having a peripheral edge arranged to dip into a water seal provided on the top edge of the gas offtake pipe when the cover is in the closed position and an inner cover having an edge to engage with an inner support surface of the gas offtake pipe.

Problems have been encountered with a closure of this type for a gas offtake pipe because the inner cover embodies a cast iron construction which is very heavy and necessitates the provision of counter weights for actuating linkage when opening or closing the cover. Also, condensate and residue unavoidably build up and crack near the cover seat so that the inner cover also becomes encrusted. When this occurs, a considerable force must be exerted sometimes requiring the assistance of a braker rod to open the cover.

SUMMARY OF THE INVENTION

It is an object of the present invention to provide a gas offtake pipe closure embodying a light-weight construction and design to obviate sticking of an inner cover to a seating surface therefore and to greatly reduce or obviate servicing and cleaning operations heretofore necessary.

According to the present invention, there is provided a closure for closing an opening at the upper end of a vertically arranged gas offtake pipe which is disposed on the roof of a coke oven to conduct raw gas evolving in a coke oven chamber of the coke oven to a gas main during the coking of coal, the closure including liquid holding means for forming a water seal including a U-shaped annular base at the top of the gas offtake pipe, a domed top cover having a peripheral edge for dipping in the water seal at the top of the gas offtake pipe, a curved inner cover comprising a spherical shaped metal plate with the convexity thereof extending toward the interior of the gas offtake pipe, and an annular wall extending interiorly of and surrounded by the water seal, the annular wall having a top edge disposed above the top edge of U-shaped annular base of the water seal for sealing engagement with a peripheral edge of the curved inner cover.

Preferably, the parts forming the closure of the present invention are arranged such that the top edge of the water seal is disposed near the top edge of the annular wall which sealingly engages the peripheral edge of the curved inner cover. In one embodiment, the base of the water seal is formed with a prolonged base portion extending inwardly of the water seal and releasably engaging the aforesaid annular ring. Spacers are arranged between an inner wall of the water seal and the annular ring to concentrically position the ring with respect to the gas offtake pipe. In another embodiment, the base of the water seal is also provided with a prolonged base portion, inwardly of the water seal and the annular ring is constructed as an integral part of the prolonged base portion. The domed cover and the curved inner cover are preferably interconnected by means that may include a threaded fastener. A lever arm connected by universal joint to the domed cover and the curved inner cover is provided for raising and lowering the covers relative to the gas offtake pipe.

Practical tests carried out on the closure according to the present invention have demonstrated an absence, even after six weeks of operation, of disturbing condensate and residues which are likely to cause the inner cover to stick to the gas sealing surface therefore. This result is surprising because it has previously been necessary to clean the closures at least after a few days of operation. The surprising results are attributed inter alia to the fact that the inner cover is arranged so that the convexity of its disk-shaped configuration extends downwardly and that there is only edge contact between the cover and the sealing surface. Consequently, any condensate accumulating on the inner cover cannot collect near the sealing edge but trickles downwardly to the lowest point on the cover where it collects and the condensate drips from the cover through the offtake pipe into the oven chamber. Any filigree-like cracking of residues which drop from the parts in this zone fall back into the oven chamber particularly, due to vibrations which occur when the cover is actuated to an open position. A formation of condensate is further affected by the formation on an insulating space between the inner wall of the water seal and the annular wall spaced interiorly thereof forming the seal surface for the inner cover. Condensate is precipitated on vertical surfaces and no longer flows to a sealing edge where it can build up. It is also suspected that soiling on the underside of the cover and on the sealing surfaces thereof is greatly reduced because the sealing edge of the inner cover is located at an elevation which is higher than sealing surfaces provided in known forms of closures for gas offtake pipes. In this way, gas evolving during the coking operation can be sucked directly into the gas main at a point further away from the sealing surface.

BRIEF DESCRIPTION OF THE DRAWINGS

These features and advantages of the present invention as well as others will be more fully understood when the following description is read in light of the accompanying drawings in which.

DESCRIPTION OF THE PREFERRED EMBODIMENTS

Figure 1:
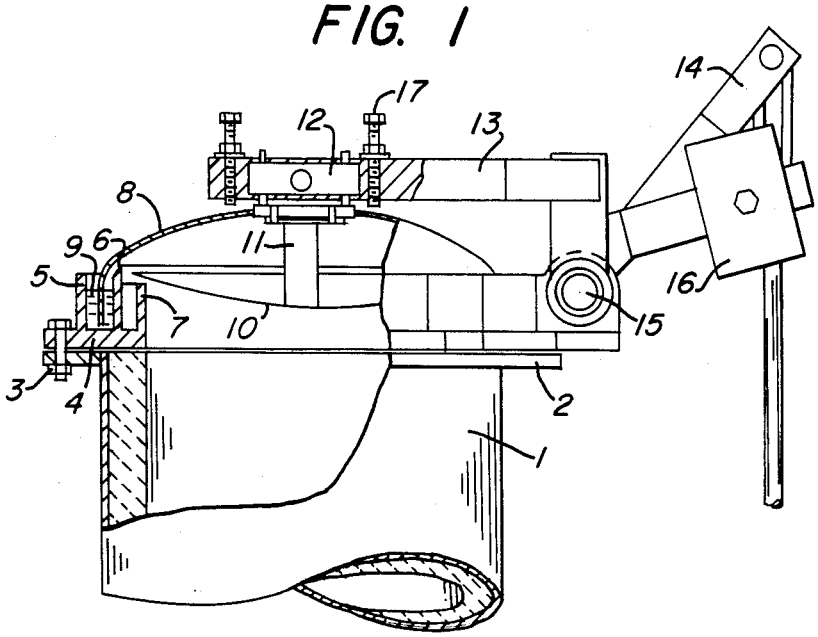
FIG. 1 is an elevational view partly in section illustrating the upper end portion of a gas offtake pipe and a closure therefore embodying the features of the present invention.
Figure 2:
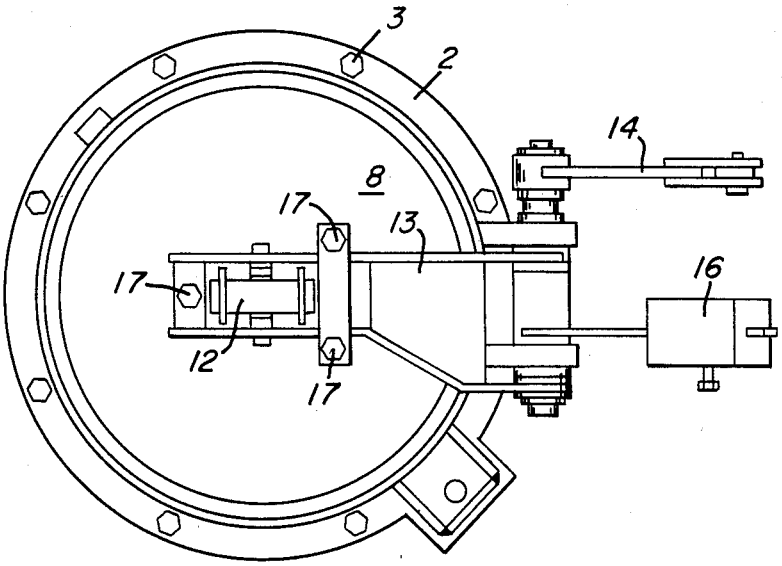
FIG. 2 is a plane view of the closure and gas offtake pipe shown in FIG. 1.

In FIG. 1, there is illustrated the upper portion of a gas offtake pipe 1 having at its upper end a peripheral flange 2 to which there is secured by screws 3 a base 4 of a water seal 9 forming part of the closure according to the present invention. The water seal further includes an outer annular wall 5 and an inner annular wall 6 extending upwardly from the base 4. The base is prolonged toward the interior of the pipe 1 and extending upwardly from the prolonged portion of the base is an annular wall 7 interiorly of the water seal and disposed concentrically with the opening of the offtake pipe. Wall 7 is spaced at a distance inwardly from the inner wall 6. In the embodiment illustrated in FIG. 1 and 2, the water seal 9 is formed as a unitary element preferably as a casting comprised of base 4, walls 5 and 6 and annular wall 7. The wall 7 can, according to the embodiment of the present invention illustrated in FIG. 3, take the form of an annular wall 7A which is releasably placed on an inwardly extending base portion 4A of the water seal 9A. The wall 7A is positioned in a concentric relation with the gas offtake pipe 1 by spacers 20 that are inserted between the inner wall 6A and the annular wall 7A at numerous places uniformly spaced around the periphery of these parts.

Figure 3:
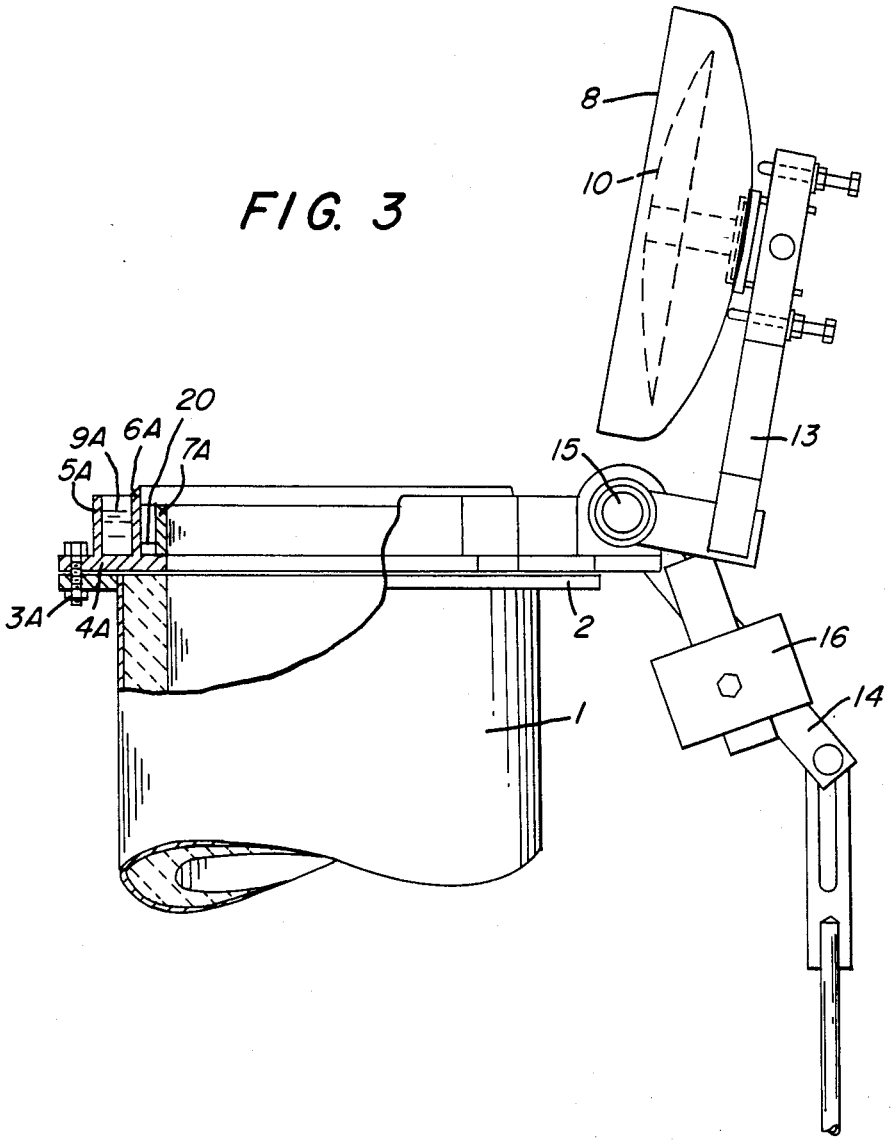
FIG. 3 is a view similar to FIG. 1 illustrating a further embodiment of closure and illustrating the inner and outer covers in an open position.

The closure of the present invention further includes a part which can be pivoted from a closed position shown in FIG. 1 into an open position shown in FIG. 3. This part of the closure takes the form of a domed top cover 8 best shown in FIG. 1. The outer peripheral edge of the top cover 8, when in the closed position, dips into the water seal 9 which is filled with water or some other appropriate liquid to provide a gas-tight closure. According to the present invention, an inner cover 10 is comprised of a curved metal plate in the form of a part spherical member which is arranged so that in the closed position, the convexity of the cover faces downward, i.e., the convexity of the spherically-shaped metal plate faces toward the interior of pipe 1. The inner cover 10 is secured at a distance from the inside surface of the top cover 8 by means of a tubular support or spacer 11 which is connected, for example, by welding, to the central part of the inner cover so that the other, upper end of the spacer is disposed centrally in the top cover 8. The spacer 11 in the illustrated embodiments, includes a flange which is attached by threaded fasteners to the top cover 8. In this way, the top cover 8 and the inner cover 10 are joined in a unitary manner. Independent mobility of the top cover 8 relative to the inner cover 10 is not necessary because the top cover does not provide surface sealing since tight sealing is achieved by the use of the water seal. To ensure satisfactory tight sealing when unavoidable stresses or distortions occur due to the effect of heat, for example, if the closures are in an open position with respect to the gas offtake pipes for a long period of time, the top cover with the inner cover secured to it can be connected by way of a universal joint 12 to a pivot lever 13 of linkage 14. The closure can also be used with a cardan suspension. The pivoting mechanism pivots about a fulcrum 15 and has, in a conventional manner, a counterweight 16 to reduce the force needed to lift the covers 8 and 10 as a unit. Three adjusting screws 17 in the pivot lever 13 can be moved to a position to reduce the mobility of the top cover to a necessary minimum.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A closure in combination with and closing a generally horizontal opening at an upper end of a vertically arranged gas offtake pipe for disposal on a roof of a coke oven to conduct raw gas evolving during coking of coal, said closure including a liquid holding means including a generally horizontal base joined with an inner seal wall and an outer seal wall for forming a water seal around the periphery of said opening at the upper end of said gas offtake pipe, a domed shaped top cover having an annular peripheral edge at the periphery thereof for dipping into said liquid holding means when the top cover is in a closed position, a spherically shaped inner cover plate supported beneath said domed shaped top cover with the convexity thereof extending downwardly into the upper end of said gas offtake pipe when the top and inner covers are in a closed position to confront raw gas conducted by the gas offtake pipe while an outer peripheral sealing edge of the inner cover plate extends upwardly above the upper end of said gas offtake pipe, a means for positioning said inner cover plate and said domed shaped top cover in an open position and a closed position, and an annular wall connected to said base and extending between said gas offtake pipe and said outer peripheral sealing edge of the inner cover plate interiorly of said liquid holding means, said annular wall having a top edge disposed above said base for sealiang engagement with said outer peripheral sealing edge of said spherically shaped inner cover plate.

2. The closure according to claim 1 wherein said base and said annular wall comprise a one-piece structure.

3. The closure according to claim 1 wherein said base includes a prolonged horizontal portion extending inwardly of said liquid holding means, said annular wall releasably connected to said prolonged horizontal portion, and spacers arranged between said inner seal wall and said annular wall to concentrically position the annular wall with said gas offtake pipe.

4. The closure according to claim 1 wherein said base includes a prolonged horizontal portion extending inwardly of said liquid holding means, said annular wall being spaced inwardly from said inner seal wall of said liquid holding means, said annular wall and said prolonged horizontal portion of said base comprises a one-piece structure.

5. The closure according to claim 1 further including means for rigidly interconnecting said domed shaped top cover and said spherically shaped inner cover plate.

6. The closure according to claim 5 wherein said means for rigidly interconnecting includes a threaded fastener.

7. The closure according to claim 1 wherein said positioning means includes a lever arm connected by a universal joint to said domed shaped top cover and said spherically shaped inner cover plate for raising and lowering the same relative to said gas offtake pipe.

* * * * *